US007849718B2

(12) United States Patent
Ambrass

(10) Patent No.: US 7,849,718 B2
(45) Date of Patent: Dec. 14, 2010

(54) DEADBOLT DEVICE FOR A DOOR

(75) Inventor: Timothy Ambrass, Pittsburgh, PA (US)

(73) Assignee: C.R. Laurence Company, Inc., Los Angeles, CA (US)

( * ) Notice: Subject to any disclaimer, the term of this patent is extended or adjusted under 35 U.S.C. 154(b) by 622 days.

(21) Appl. No.: 11/982,983

(22) Filed: Nov. 6, 2007

(65) Prior Publication Data

US 2009/0113955 A1 May 7, 2009

(51) Int. Cl.
*E05B 65/10* (2006.01)

(52) U.S. Cl. ..... 70/92; 70/150; 70/108; 292/92; 292/336.3; 292/167

(58) Field of Classification Search ..... 70/92, 70/103, 108, 113, 114, 130, 150, 152; 292/92, 292/93, 223, 226, 336.3, 166–168
See application file for complete search history.

(56) References Cited

U.S. PATENT DOCUMENTS 1,530,655 A * 3/1925 Dowling ..... 70/116
1,554,839 A * 9/1925 Brown ..... 70/150
2,533,023 A * 12/1950 Lickteig ..... 292/169.15
3,334,500 A * 8/1967 Bejarano ..... 70/92
3,563,585 A * 2/1971 Welch ..... 292/92
3,765,198 A * 10/1973 Horgan, Jr. ..... 70/92
3,899,906 A * 8/1975 Bradstock ..... 70/139
4,006,768 A 2/1977 Horgan, Jr.
4,103,874 A 8/1978 Horgan, Jr.
4,155,540 A 5/1979 Horgan, Jr.
4,218,903 A * 8/1980 Eads ..... 70/107
4,248,452 A * 2/1981 Allenbaugh ..... 292/167
D267,274 S 12/1982 Horgan, Jr.
D267,275 S 12/1982 Horgan, Jr.
D267,276 S 12/1982 Horgan, Jr.
4,366,974 A 1/1983 Horgan, Jr.
4,382,620 A 5/1983 Horgan, Jr.
4,418,949 A 12/1983 Horgan, Jr.
4,506,922 A 3/1985 Horgan, Jr.
4,523,414 A 6/1985 Horgan, Jr.
4,680,903 A 7/1987 Horgan, Jr.
4,688,406 A 8/1987 Horgan, Jr.
4,711,480 A 12/1987 Horgan, Jr.
4,763,453 A 8/1988 Horgan, Jr.
4,793,115 A 12/1988 Horgan, Jr.
4,875,722 A 10/1989 Miller et al.

(Continued)

*Primary Examiner*—Suzanne D Barrett
(74) *Attorney, Agent, or Firm*—Luce, Forward, Hamilton & Scripps LLP

(57) ABSTRACT

A deadbolt device for a door is disclosed that has a linkage assembly enclosed within a handle. The linkage assembly extends from a first end to a second end and is moveable from a locked position to an unlocked position. A lock housing extends through the door and includes a guide channel that extends from an interior side of the lock housing to an exterior side of the lock housing. A locking member, at least a portion of which is in the guide channel, is operatively connected to the linkage assembly and is moveable from a locked position to an unlocked position, which correspond to those of the linkage assembly. A biasing mechanism is operatively connected to the locking member and biases the locking member to its locked position. A dogging member is moveably connected to the lock housing such that the dogging member can move from an undogged to a dogged position.

17 Claims, 5 Drawing Sheets

U.S. PATENT DOCUMENTS 4,892,338 A * 1/1990 Weinerman et al. ..... 292/35
4,895,399 A 1/1990 Horgan, Jr.
4,956,954 A 9/1990 Horgan, Jr.
5,283,978 A 2/1994 Horgan, Jr.
D355,037 S 1/1995 Horgan, Jr.
5,524,942 A * 6/1996 Fleming ..... 292/34
5,941,581 A 8/1999 Heithe
6,135,512 A 10/2000 Galvin
D444,241 S 6/2001 Horgan, Jr.
6,511,104 B1 1/2003 Horgan, Jr.
6,536,245 B2 3/2003 Chiang
6,726,257 B2 4/2004 Horgan, Jr.
6,729,169 B2 5/2004 Moore
6,820,905 B1 * 11/2004 Haeck et al. ..... 292/93
7,165,428 B2 1/2007 Isaacs et al.
2010/0117376 A1 * 5/2010 Shen ..... 292/92

* cited by examiner 19
2
3
3
2
22
13
12
4
23
11
24
A
6
8
15
10
20
18
B
B
9
7
26
31
33
16
25
A 19
2
3
3
2
22
4
23
24
20
6
12
15
10
25
31
8
18
C
C
9
7
26
33
16
13

DEADBOLT DEVICE FOR A DOOR

FIELD OF INVENTION

The present invention is directed toward deadbolt devices for doors and, more particularly, toward a deadbolt device having a biasing mechanism biasing the deadbolt to a locked position.

BACKGROUND OF THE INVENTION

Deadbolts may be provided in combination with doors to ensure a door can be locked. Some deadbolts may be provided near the bottom of the door, away from the handle. One such deadbolt is disclosed in U.S. Pat. No. 4,688,406. Such deadbolts use locking bolts that extend from a shoe of the door into a recess located in the floor adjacent the door to lock the door.

The deadbolt disclosed in U.S. Pat. No. 4,688,406 requires a user to manipulate the deadbolt near the top or bottom of a door, which can be difficult for some users to operate. Further, deadbolts usually require a user to place the door in a closed position prior to moving the deadbolt into a locked position. When the user wishes to open the door, the user typically has to manually manipulate the deadbolt to an unlocked position prior to opening the door, and then also has to manually manipulate the deadbolt again to relock the door.

Users may often forget to relock a deadbolt after opening a door to leave a room or building. Such forgetfulness can expose residents to unwanted visitors that may gain access to a room or building through such an unlocked door. In some cases, the residents may be physically or financially harmed by such visitors.

A deadbolt is needed that is biased to a locked position so a user does not have to relock a door the user just exited. Preferably, the deadbolt is sized and configured so the door is automatically locked by the deadbolt after a user exits a room or building.

SUMMARY OF THE INVENTION

The present invention includes a deadbolt device that has a handle, a linkage assembly, a lock housing, a locking member, a biasing mechanism and a dogging member. The linkage assembly is operatively enclosed within the handle and extends from a first end within the handle to a second end. The second end of the linkage assembly is sized and configured to fit within a corresponding latching recess in the floor, the header or the door jamb to lock the door. The linkage assembly is moveable from a locked position at which the second end is extended from the handle to an unlocked position at which the second end is substantially retracted within the handle. The lock housing extends through the door and is operatively connected to the handle. The lock housing includes a guide channel that extends from the interior side of the lock housing (on the interior side of the door) to the exterior side of the lock housing (on the exterior side of the door). A locking member is provided within the lock housing and, at one end, is operatively connected to the linkage assembly. At least a portion of the locking member is within the guide channel of the lock housing.

The locking member is moveable from a locked position to an unlocked position. The locking member actuates the linkage assembly to its locked position when the locking member is in its locked position. Similarly, when the locking member is moved to the unlocked position, the locking member actuates the linkage assembly to its unlocked position.

The biasing mechanism is provided within the lock housing and is operatively connected to the locking member. The biasing mechanism biases the locking member to its locked position, which, in turn, biases the linkage assembly to its locked position.

The dogging member is moveably connected to the lock housing such that the dogging member can move from a dogged position to an undogged position. In its dogged position, the dogging member maintains the locking member in its unlocked position. In is undogged position, the dogging member allows free movement of the locking member.

In some embodiments, the second end of the linkage assembly may be substantially retracted within the handle such that the entire second end is within the handle. In other embodiments, the second end of the linkage assembly may be substantially retracted such that the second end of the linkage assembly is not fully retracted within the handle.

The dogging member or locking member may be, for example, a generally C-shaped bar or rod. The dogging member may have a first dogging pin connected to a top end of the generally C-shaped bar or rod and a second dogging pin connected to a bottom end of the generally C-shaped bar or rod. When the dogging member is in the dogged position, the first dogging pin may extend from the lock housing. When the dogging member is in the undogged position, the second dogging pin may extend from the lock housing. Thus, by actuating either pin a user can change the position of the dogging member. Of course it should be understood that the first dogging pin may extend from the bottom end of the generally C-shaped bar or rod and the second dogging pin may extend from the top end of the generally C-shaped bar or rod without departing from the spirit and scope of the present invention.

The dogging member may be configured so that a projection extends from the dogging member through a corresponding slot formed in the locking member when the dogging member is in the dogged position. When the dogging member is in the undogged position, the projection does not extend into the corresponding slot formed in the locking member. In one embodiment, the projection of the dogging member may be sized and configured to fit within the slot formed in the locking member when the locking member is in its locked position. When the dogging member is moved from the undogged position to the dogged position, the dogging member can be sized and configured to cause the locking member to move from its locked position to its unlocked position and thus be maintained in its unlocked position by the dogging member.

In some embodiments, the biasing mechanism is located within the guide channel formed in the lock housing.

A first actuating mechanism is disposed rotatably in the lock housing at the interior side thereof. The first actuating mechanism may be turned by a key (not shown) or may be turned via a thumb turn (also not shown) that may be grasped and turned by a user. The first actuating mechanism includes a butt, or cam, that is rotatable therewith and which engages a first slot formed in the locking member to move the locking member between its locked and unlocked positions.

In some embodiments, a second actuating mechanism is disposed rotatably in the lock housing at the exterior side thereof. Since security is a concern, typically the second actuating mechanism may only be turned by a key (not shown). The second actuating mechanism includes a butt, or cam, that is rotatable therewith and which engages a corresponding second slot formed in the locking member to move the locking member between its locked and unlocked positions.

In some embodiments, the first end of the linkage assembly includes an angled slot. The locking member is moveably connected to the angled slot such that an end of the locking member is positioned at the top end of the angled slot when the locking member is in its unlocked position and is positioned at the bottom end of the angled slot when the locking member is in its locked position. Movement of the locking member between the top and bottom ends of the angled slot in turn moves the linkage assembly between its unlocked and locked positions.

It should be understood that the biasing mechanism may be, for example, an elastic body or a spring.

Preferably, the locking member moves in a direction transverse to the movement of the linkage assembly and the dogging member. Movement of the dogging member may be substantially parallel to that of the linkage assembly. However, other movement directions of the linkage assembly, dogging member and locking member may be implemented without departing from the spirit and scope of the present invention.

Other details, objects, and advantages of the invention will become apparent as the following description of certain present preferred embodiments thereof proceeds.

BRIEF DESCRIPTION OF THE DRAWINGS

Certain present preferred embodiments of the inventive deadbolt device are illustrated in the accompanying drawings.

DETAILED DESCRIPTION OF THE INVENTION

Figure 1:
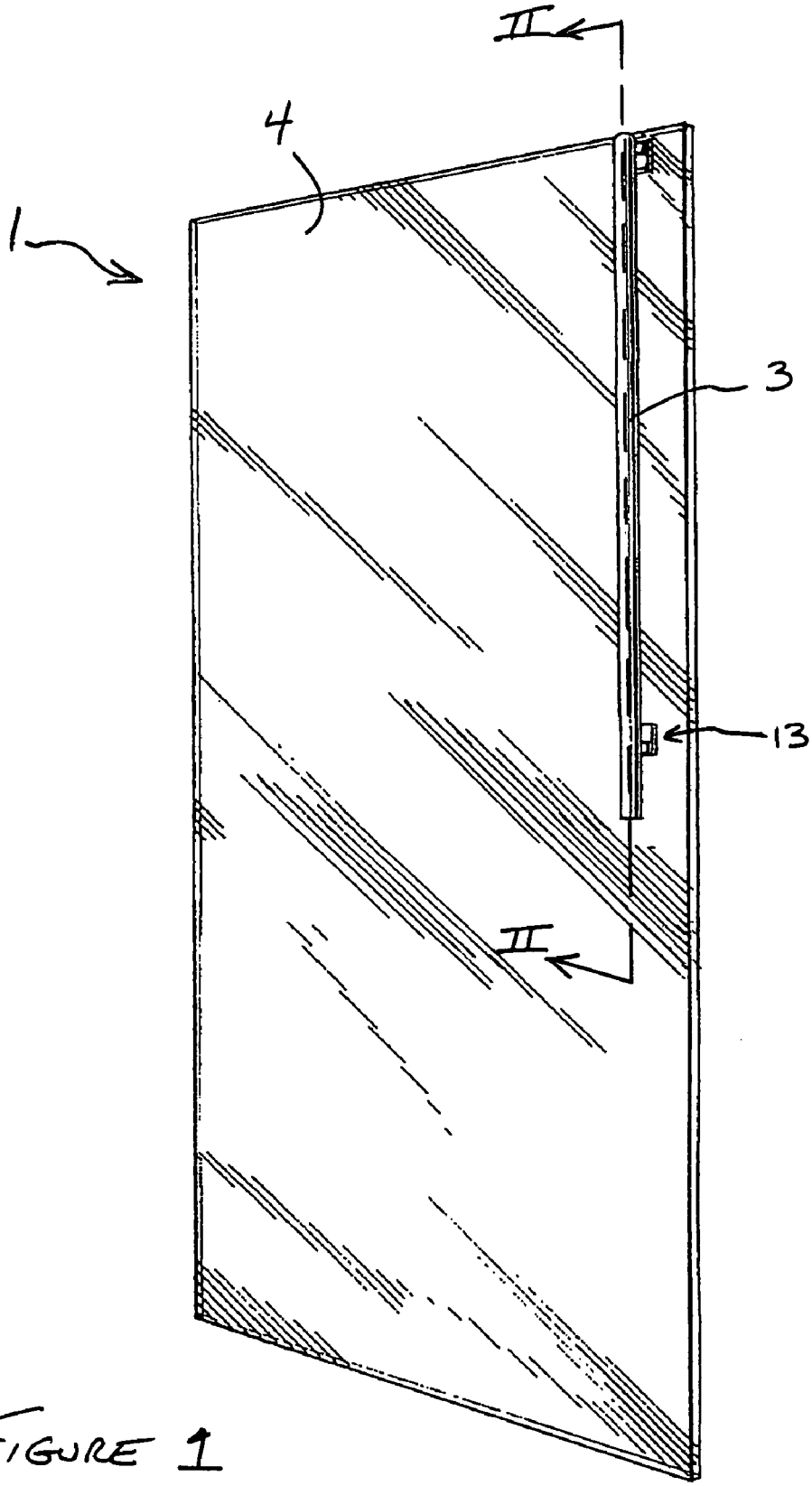
FIG. 1 is a perspective view of the interior side of a door incorporating a first embodiment of the deadbolt device.

Referring to FIGS. 1-6, a door 1 is provided that includes an embodiment of the inventive deadbolt device. The door 1 includes a handle 3 connected to the body 4 of the door on an interior side thereof. A handle 24 may also be connected to the body 4 of the door on an exterior side thereof (see FIG. 2). The exterior handle 24 is an optional feature. The door body 4 can be composed of glass, wood, metal, ceramic, composite, plastic, or any combination of thereof.

A lock housing 13 extends through the door 1 and is operatively connected to the handle 3. The lock housing 13 includes an interior side 22 located on the interior face of the door 1 and an exterior side 23 located on the exterior face of the door 1.

Figure 2:
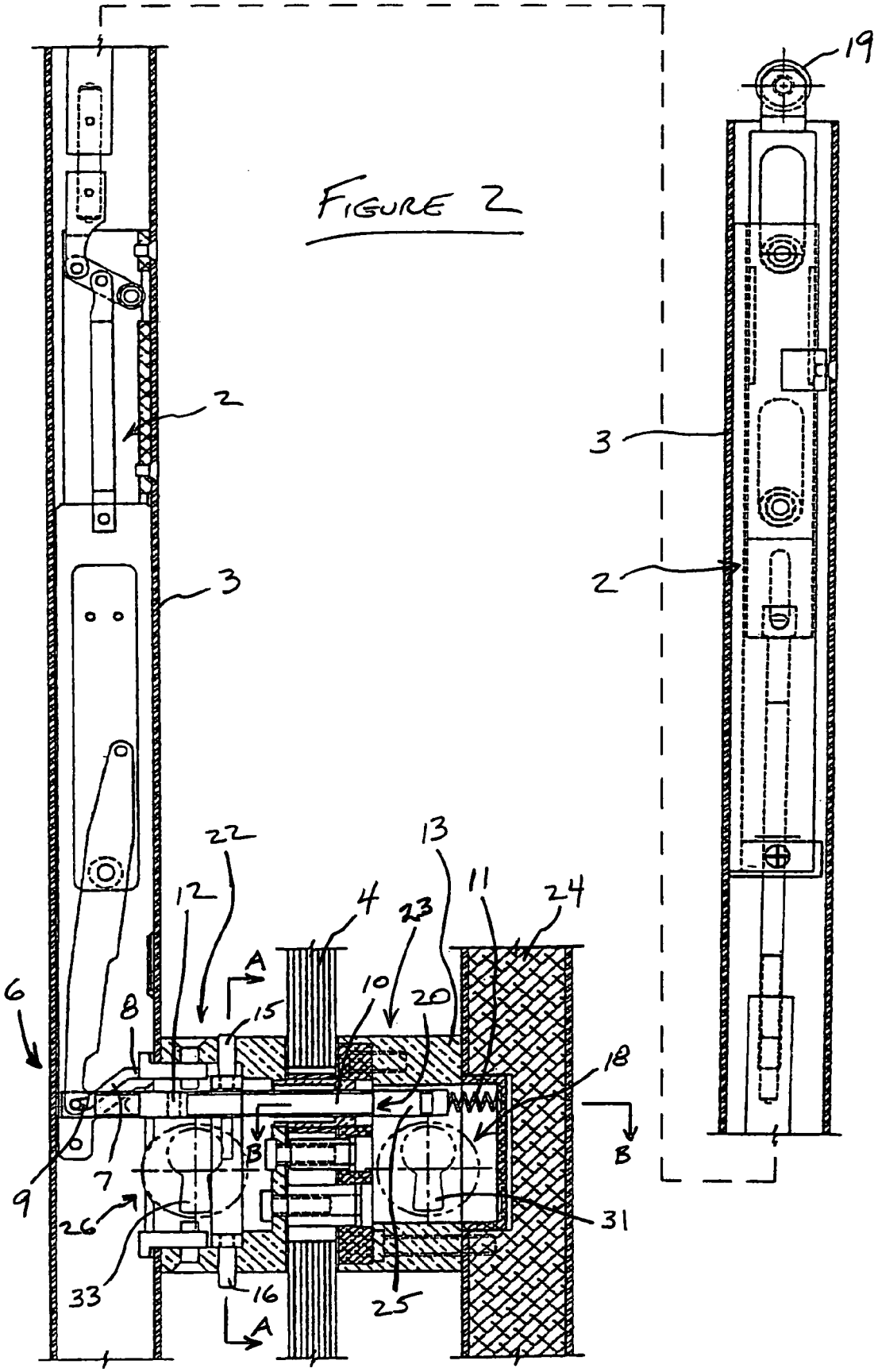
FIG. 2 is a cross-sectional view taken along line II-II in FIG. 1 illustrating the linkage assembly in a locked position, the dogging member in an undogged position and the locking member in a locked position.
Figure 5:
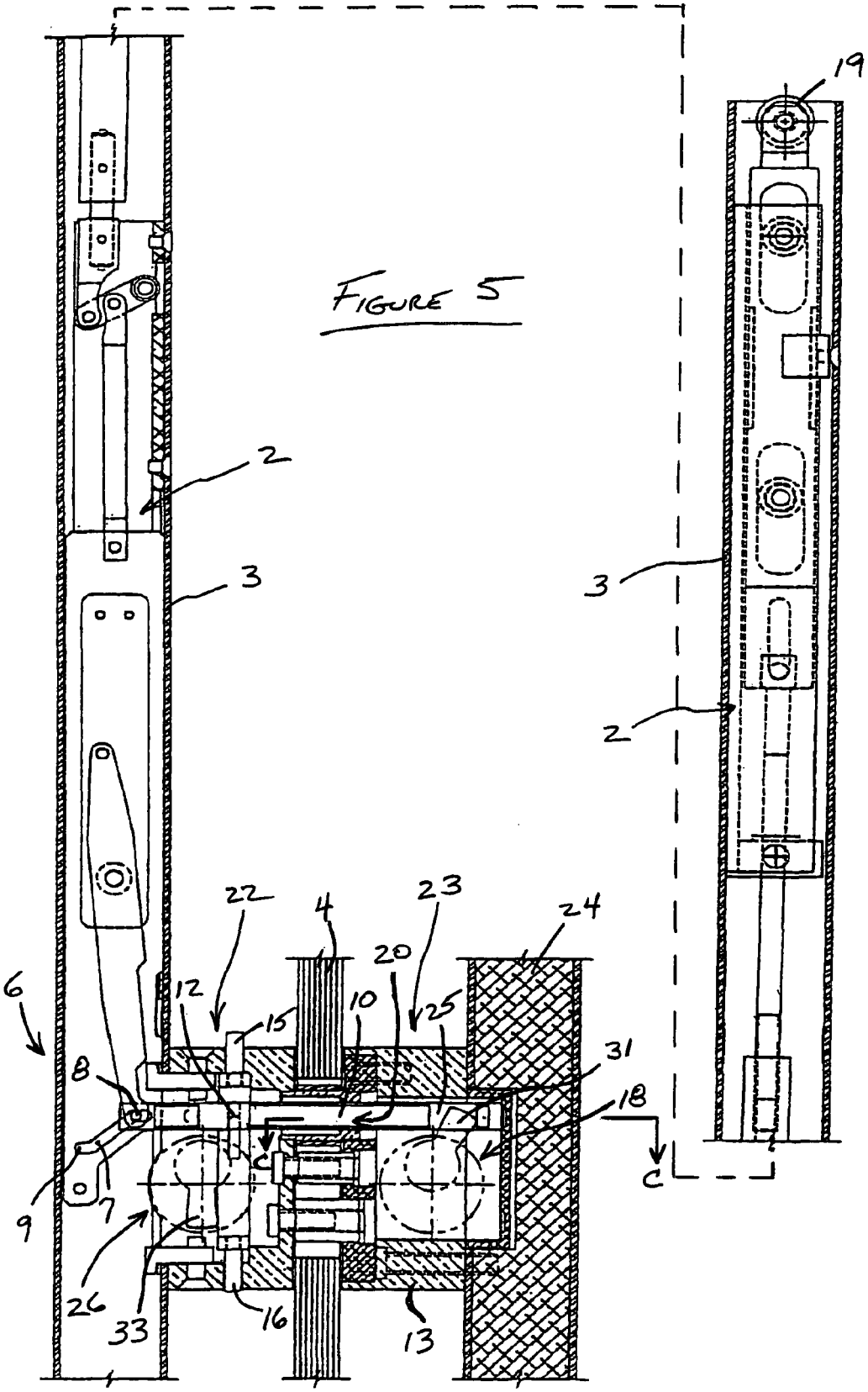
FIG. 5 is a cross-sectional view similar to that of FIG. 2, but illustrating the linkage assembly in an unlocked position, the dogging member in a dogged position and the locking member in an unlocked position.

The lock housing 13 includes a guide channel 20 that extends from the interior side 22 to the exterior side 23. A locking member 10 is provided within the lock housing 13 and is operatively connected to a linkage assembly 2 at one end. The linkage assembly 2 is enclosed within the handle 3, as shown in FIGS. 2 and 5. The linkage assembly 2 extends from a first end 6 to a second end 19. The second end 19 is configured to fit in a corresponding recess in the floor, header or door jamb to lock the door 1. The second end 19 may include a roller which moves along a ramped recess to close and lock the door 1 after it has been opened. The first end 6 has an angled slot 7. The angled slot has top 8 and bottom 9 ends. The locking member 10 is operatively connected to the linkage assembly 2 via the slot 7. At least a portion of the locking member 10 is within the guide channel 20 formed in the lock housing 13. The locking member 10 is moveable from a locked position (shown in FIG. 2) to an unlocked position (shown in FIG. 5).

A biasing mechanism 11 is provided which biases the locking member 10 in the locked position, which is shown in FIG. 2. The biasing mechanism 11 may include a spring or an elastic body and is at least partially located with the guide channel 20. When used in conjunction with a ramped recess, such as those typically included with an electric strike mechanism, the biasing mechanism 11 allows the second end 19 to move along the ramped recess as the door is being closed and then biases the second end 19 into the recess when the door 1 is closed to lock the door 1.

When the locking member 10 is in the locked position, the end of the locking member 10 is located adjacent the bottom 9 of the angled slot, which places the linkage assembly 2 in a locked position, as shown in FIG. 2. When the linkage assembly 2 is in the locked position, a user is prevented from opening the door because end 19 of the linkage assembly extends into a recess in the floor, header or door jamb adjacent the door 1. In one embodiment, such a recess is located in the top of the door jamb.

When the locking member 10 is in the unlocked position, the end of the locking member 10 is located adjacent the top 8 of the angled slot, which moves the linkage assembly 2 to the unlocked position, as shown in FIG. 5. When the linkage assembly 2 is in the unlocked position, end 19 is substantially retracted within the handle 3 such that the door 1 can be opened by a user. A user can exert a force on the handle 3, the optional exterior handle 24 or the door body 4 to open the door 1 when the linkage assembly 2 is in the unlocked position.

Figure 3:
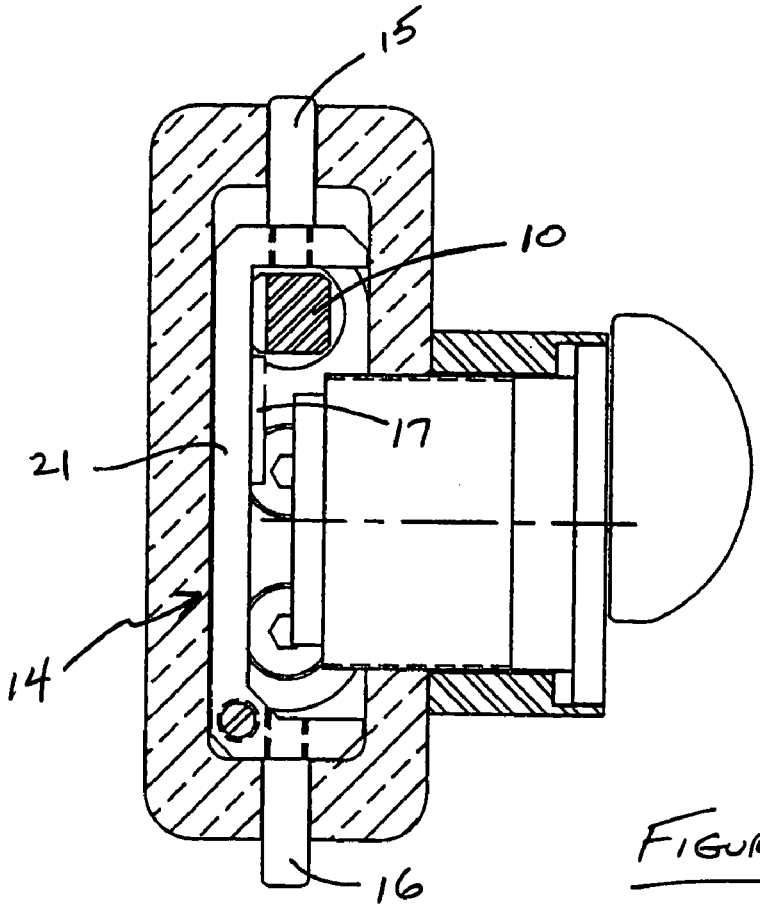
FIG. 3 is a cross-sectional view taken along line B-B in FIG. 2.

A dogging member 14 is operatively connected to the lock housing 13 and is moveable from an undogged position, which is shown in FIGS. 2 and 3, to a dogged position, which is shown in FIG. 5. The dogging member 14 includes a generally C-shaped bar or rod 21 having pins extending therefrom on opposite ends. A first dogging pin 15 is provided at one end of the generally C-shaped bar or rod 21 and a second dogging pin 16 is provided at the opposite end of the generally C-shaped bar or rod. The middle portion of the generally C-shaped bar or rod 21 also has a projection 17, which is sized and configured to fit within and cooperate with the first slot 12 formed in the locking member. When the dogging member 14 is in the dogged position, the projection 17 extends through the first slot 12 and into the guide channel 20, which prevents the locking member 10 from being biased back to its locked position. In other words, the projection 17 maintains the locking member 10 in its unlocked position. Additionally, in one embodiment the first dogging pin 15 extends from the lock housing 13 when the dogging member 14 is in the dogged position, and when the dogging member 14 is in the undogged position, the second dogging pin 16 extends from the lock housing 13 on the opposite side thereof. It should be appreciated that a user may adjust the position of the dogging member 14 from dogged to undogged and vise versa by simply pushing the dogging pin that is extending from the lock housing 13 back into the lock housing 13.

The projection 17 of the dogging member 14 may be sized and configured so that the projection 17 can only fit within the first slot 12 when the locking member 10 is in the unlocked position. Other embodiments may have a dogging member 14 with a projection 17 that is sized and configured to engage the first slot 12 of the locking member 10 when the locking member 10 is in the locked position. For example, either the first slot 12 or projection 17 can be sized and configured at an angle so that when the dogging member 14 is moved to the dogged position, the projection 17 can operatively engage the slot 12 in the locking member 10 and move the locking member 10 to the unlocked position as the dogging member 14 is moved to the dogged position. Once in the dogged position, the dogging member 14 maintains the locking member 10 in the unlocked position.

The dogging member 14 may be moveably connected to the lock housing 13 such that the movement of the dogging member 14 is in a direction that is substantially perpendicular to the movement of the locking member 10, as shown in FIGS. 2 and 5. However, movement in directions other than substantially perpendicular are also contemplated. The dogging member 14 is described herein as a generally C-shaped bar or rod having pins extending from opposite ends. However, the dogging member 14 may also be configured to have various other shaped bodies without departing from the spirit and scope of the present invention. Since the dogging member 14 is designed to maintain the locking member 10 in an unlocked position, the dogging member 14 is typically disposed in the interior side 22 of the lock housing 13.

It should be noted that the locking member 10 may be a bar, a rod or have some other shaped body.

A first actuating mechanism 26 may be rotatably provided in the interior side 22 of the lock housing 13. The first actuating mechanism 26 may be rotated via a key (not shown) or may be rotated via a thumb turn (also not shown) that may be grasped and turned by a user. The first actuating mechanism 26 includes a butt, or cam, 33 that is rotatable therewith and which engages the slot 12 formed in the locking member 10 to move the locking member 10 to an unlocked position as the first actuating mechanism 26 is rotated in a clockwise direction.

A second actuating mechanism 18 is rotatably provided in the exterior side 23 of the lock housing 13. The second actuating mechanism 18 is rotatable between a first position shown in FIG. 2 and a second position shown in FIG. 5. Since the second actuating mechanism 18 is located on the exterior side 23 of the lock housing 13, typically a key (not shown) or other security device will be required to rotate the second actuating mechanism 18. The second actuating mechanism 18 includes a butt, or cam, 31 that is rotatable therewith and which engages a slot 25 formed in the locking member 10 to move the locking member 10 to an unlocked position as the second actuating member 18 is rotated from its first to its second position in a clockwise direction.

Figure 4:
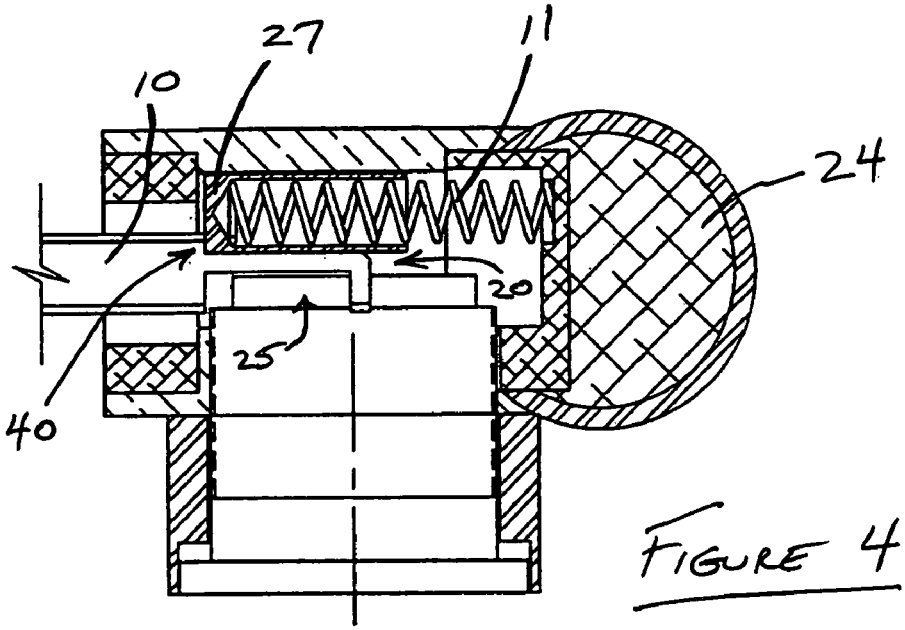
FIG. 4 is a cross-sectional view taken along line A-A in FIG. 2.
Figure 6:
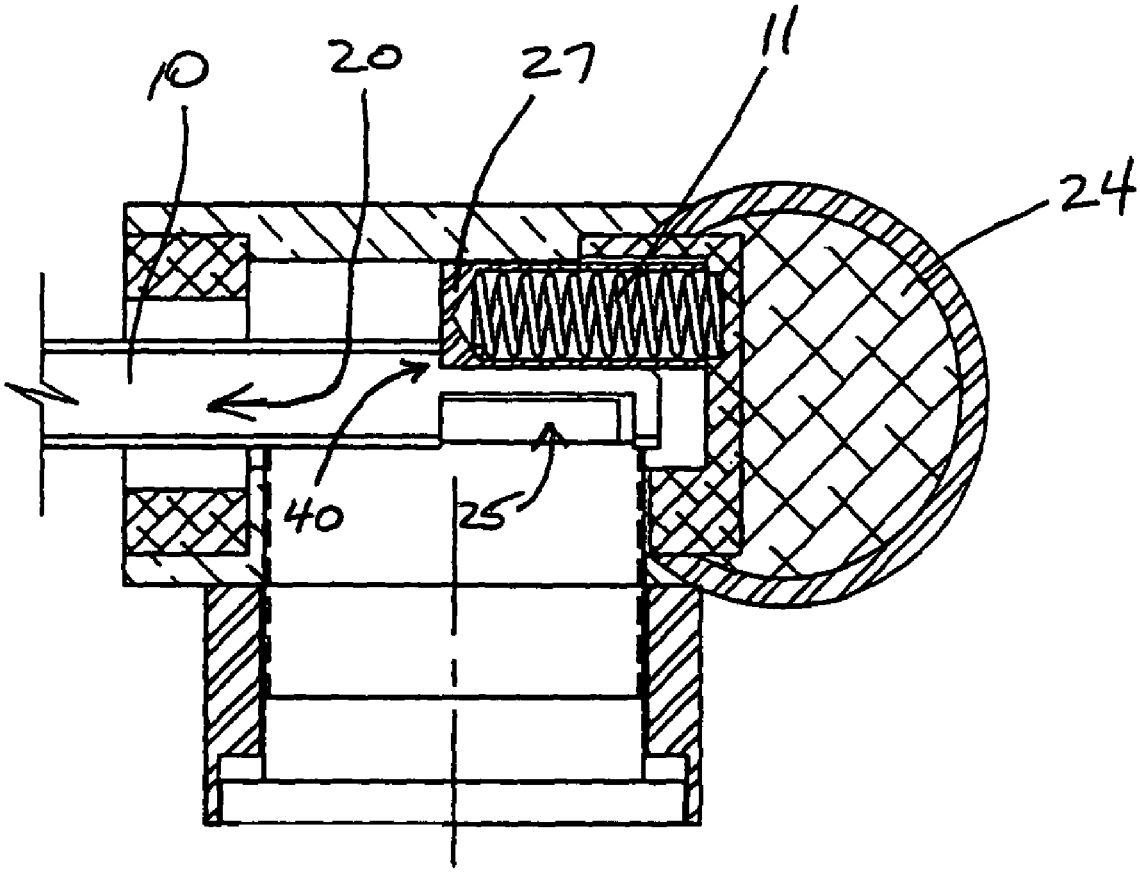
FIG. 6 is a cross-sectional view taken along line C-C in FIG. 5.

A guide body 27 may also be provided positioned within the guide channel 20 between the locking member 10 and the biasing mechanism 11, as shown in FIGS. 4 and 6. The guide body 27 receives the biasing mechanism 11 and engages a ledge 40 formed in the locking member 10 to bias the locking member 10 to the locked position.

While certain present preferred embodiments of the deadbolt device have been shown and described and certain present preferred methods of making and using the same have been illustrated, it is to be distinctly understood that the invention is not limited thereto but may be otherwise variously embodied and practiced within the scope of the following claims.

What is claimed is:

1. A deadbolt device for a door comprising:

a handle operatively connected to a door;

a linkage assembly operatively enclosed within the handle, the linkage assembly extending from a first end to a second end, the linkage assembly being moveable from a locked position at which the second end extends from the handle to an unlocked position at which the second end is substantially retracted within the handle;

a lock housing extending through the door and operatively connected to the handle, the lock housing having an interior side and an exterior side, and a guide channel extending from the interior side to the exterior side;

a locking member operatively connected to the linkage assembly, at least a portion of the locking member disposed within the guide channel, the locking member being moveable from a locked position to an unlocked position corresponding to the locked and unlocked positions of the linkage assembly; and a biasing mechanism operatively connected to the locking member, the biasing mechanism biasing the locking member to its locked position.

2. The deadbolt device of claim 1, further comprising a dogging member moveably connected to the lock housing such that the dogging member can move from an undogged position to a dogged position, wherein the dogging member maintains the locking member in its unlocked position when the dogging member is in the dogged position.

3. The deadbolt device of claim 2, wherein the dogging member has a first end having a first dogging pin connected thereto and a second end having a second dogging pin connected thereto, wherein at least a portion of the first dogging pin extends from the lock housing when the dogging member is in the dogged position and at least a portion of the second dogging pin extends from the lock housing when the dogging member is in the undogged position.

4. The deadbolt device of claim 3, wherein the first dogging pin, second dogging pin, and dogging member are a unitary structure.

5. The deadbolt device of claim 1, wherein at least a portion of the biasing mechanism is located within the guide channel, the deadbolt device further comprising a guide body positioned within the guide channel between the locking member and the biasing mechanism, the guide body operatively engaging the biasing mechanism and the locking member.

6. The deadbolt device of claim 1, further comprising a first actuating mechanism disposed rotatably in the lock housing adjacent the interior side thereof, the first actuator mechanism having a rotatable cam sized and configured to engage a first slot formed in the locking member to move the locking member from its locked position to its unlocked position when the first actuating mechanism is rotated between first and second positions.

7. The deadbolt device of claim 6, further comprising a second actuating mechanism disposed rotatably in the lock housing at the exterior side thereof, the second actuating mechanism having a rotatable cam sized and configured to engage a second slot formed in the locking member to move the locking member from its locked position to its unlocked position when the second actuating mechanism is rotated between first and second positions.

8. The deadbolt device of claim 1, wherein the locking member includes a first end and a second end, wherein the second end of the linkage assembly includes an angled slot, the angled slot having a top end and a bottom end, the first end of the locking member operatively engaging the linkage assembly at the angled slot such that the first end of the locking member is positioned at the top end of the angled slot when the locking member is in its unlocked position and is positioned at the bottom end of the slot when the locking member is in its locked position.

9. The deadbolt device of claim 1, wherein the second end of the linkage assembly is sized and configured to be received in a latching recess adjacent the door when the linkage assembly is in the locked position.

10. The deadbolt device of claim 1, wherein the biasing mechanism is comprised of at least one of a metal spring and an elastic body.

11. The deadbolt device of claim 2, wherein the dogging member includes a projection sized and configured to engage a first slot formed in the locking member to move the locking member from its locked position to its unlocked position as the dogging member is moved from its undogged position to its dogged position.

12. The deadbolt device of claim 1, wherein movement of the locking member is in a direction that is substantially perpendicular to the movement of the linkage assembly.

13. The deadbolt device of claim 2, wherein movement of the dogging member is in a direction that is substantially perpendicular to movement of the locking member.

14. The deadbolt device of claim 2, wherein the dogging member comprised a generally C-shaped bar or rod.

15. The deadbolt device of claim 1, wherein the locking member comprises a bar or rod.

16. The deadbolt device of claim 1, wherein movement of the dogging member is in a direction that is substantially parallel to movement of the linkage assembly.

17. The deadbolt device of claim 2, wherein the locking member includes a first slot, and wherein the dogging member includes a projection sized and configured to engage a first slot formed in the locking member to maintain the locking member in its unlocked position when the dogging member is moved from its undogged position to its dogged position.

* * * * *